US005679894A

United States Patent [19]

Kruger et al.

[11] Patent Number: 5,679,894

[45] Date of Patent: Oct. 21, 1997

[54] APPARATUS AND METHOD FOR DRILLING BOREHOLES

[75] Inventors: Volker Kruger, Celle, Germany; John W. Harrell, Spring; Herbert W. Beimgraben, Houston, both of Tex.

[73] Assignee: Baker Hughes Incorporated, Houston, Tex.

[21] Appl. No.: 544,422

[22] Filed: Oct. 10, 1995

Related U.S. Application Data

[63] Continuation-in-part of Ser. No. 212,230, Mar. 14, 1994, Pat. No. 5,456,106, which is a continuation-in-part of Ser. No. 60,563, May 12, 1993, Pat. No. 5,325,714.

[51] Int. Cl.[6] ..... E21B 44/00; E21B 47/00

[52] U.S. Cl. ..... 73/152.03; 73/152.01; 73/152.52; 166/250; 175/39; 175/50

[58] Field of Search ..... 73/151, 152, 152.01, 73/152.03, 152.48, 152.52; 166/250; 175/39, 50, 40

[56] References Cited

U.S. PATENT DOCUMENTS

| | | | |
|---|---|---|---|
| 4,396,071 | 8/1983 | Stephens | 170/50 |
| 4,593,559 | 6/1986 | Brown et al. | 73/151 |
| 4,608,861 | 9/1986 | Wachtler et al. | 73/151 |
| 4,627,276 | 12/1986 | Burgess et al. | 73/151 |
| 4,660,656 | 4/1987 | Warren et al. | 175/26 |
| 4,685,329 | 8/1987 | Burgess | 73/151 |
| 4,729,675 | 3/1988 | Trzeciak et al. | 384/613 |
| 4,734,892 | 3/1988 | Kottyar | 367/83 |
| 4,773,263 | 9/1988 | Lesage et al. | 73/151 |
| 4,797,822 | 1/1989 | Peters | 364/422 |
| 4,926,686 | 5/1990 | Fay | 73/151 |
| 4,958,517 | 9/1990 | Maron | 73/151 |
| 4,982,801 | 1/1991 | Zitka et al. | 173/163 |

(List continued on next page.)

FOREIGN PATENT DOCUMENTS

| | | | |
|---|---|---|---|
| 1472655 | 5/1987 | European Pat. Off. . | |
| 0551134 | 7/1993 | European Pat. Off. . | |
| 0553908 | 8/1993 | European Pat. Off. | 47/12 |
| 2183272 | 6/1987 | United Kingdom . | |

*Primary Examiner*—Hezron E. Williams
*Assistant Examiner*—J. David Wiggins
*Attorney, Agent, or Firm*—Madan & Morris, PLLC

[57] ABSTRACT

The present invention provides a drilling system for directional drilling of boreholes. The system contains a drill string having a drill bit driven by a positive displacement mud motor. Sensors placed at selected locations in the drill string continually measure various downhole operating parameters, including the differential pressure across the mud motor, rotational speed of the mud motor, torque, temperature, pressure differential between the fluid passing through the mud motor and the annulas between the drill string and the borehole, and temperature of the circulating fluid. A downhole control circuit having a microprocessor and nonvolatile memory processes signals from these sensors and transmits the processed data uphole to a surface control unit via a suitable telemetry system. The surface control unit is programmed to operate the drilling system or aid an operator to control the drilling operations in any number of modes in response to the information provided by the various sensors. The system also provides means for monitoring the wear condition of the mud motor and to estimate the remaining life of the mud motor during the drilling operations. The drill string also preferably contains formation evaluation and testing devices, such as a resistivity device for determining the formation resistivity, gamma ray device for determining the gamma ray intensity of the formation, an inclinometer for determining the inclination of the drill string near the drill bit and a device for determining the drill string azimuth. The present invention provides method for controlling the drilling operations that contains the steps of: (a) placing a drill string at the borehole bottom, (b) passing a pressurized fluid through the mud motor rotate the drill bit, (c) measuring differential pressure across the mud motor; and (d) controlling the drilling of the boreholes as a function of the differential pressure.

82 Claims, 5 Drawing Sheets

U.S. PATENT DOCUMENTS

| | | | |
|---|---|---|---|
| 5,074,681 | 12/1991 | Turner et al. | 384/613 |
| 5,135,059 | 8/1992 | Turner et al. | 175/101 |
| 5,141,061 | 8/1992 | Henneuse | 175/56 |
| 5,216,917 | 6/1993 | Detournay | 73/151 |
| 5,226,332 | 7/1993 | Wassell | 73/151 |
| 5,245,871 | 9/1993 | Henneuse et al. | 73/151 |
| 5,269,383 | 12/1993 | Forrest | 175/26 |
| 5,280,243 | 1/1994 | Miller | 324/303 |
| 5,305,836 | 4/1994 | Holbrook et al. | 175/39 |
| 5,325,714 | 7/1994 | Lende et al. | 73/153 |
| 5,368,108 | 11/1994 | Aldred et al. | 175/40 |
| 5,368,446 | 11/1994 | Rode | 417/18 |
| 5,456,106 | 10/1995 | Harvey et al. | 73/153 |
| 5,509,303 | 4/1996 | Georgi | 73/151 |

APPARATUS AND METHOD FOR DRILLING BOREHOLES

CROSS-REFERENCE TO RELATED APPLICATIONS

This application is a continuation-in-part of U.S. patent application Ser. No. 08/212,230 which issued as U.S. Pat. No. 5,456,106 filed on Mar. 3, 1994, which is a continuation-in-part of U.S. patent application Ser. No. 08/060,563, which issued as U.S. Pat. No. 5,325,714 filed on May 12, 1993.

BACKGROUND OF THE INVENTION

1. Field of the Invention

This invention relates generally to systems for drilling boreholes for the production of hydrocarbons and more particularly to a drilling system which utilizes direct measurements of selected drill motor assembly parameters to control the drilling operations so as to increase the useful life of the drill motor assembly and to improve the overall drilling efficiency.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes, to increase the hydrocarbon production and/or to withdraw additional hydrocarbons from the earth's formations.

Modern directional drilling systems generally employ a drill string having a drill bit at the bottom that is rotated by a drill motor (commonly referred to as the "mud motor"). A plurality of downhole devices are placed in close proximity to the drill bit to measure certain downhole operating parameters associated with the drill string and to navigate the drill bit along a desired drill path. Such devices typically include sensors for measuring downhole temperature and pressure, azimuth and inclination measuring device and a resistivity measuring device to determine the presence of hydrocarbons against water. Additional downhole instruments, known as logging-while-drilling ("LWD") tools, are frequently attached to the drill string to determine the formation geology and formation fluid conditions during the drilling operations.

Positive displacement motors are commonly used as mud motors. U.S. Pat. No. 5,135,059, assigned to the assignee hereof and which is incorporated herein by reference, discloses a downhole drill motor that includes a power section having a housing, a stator having a helically-lobed inner elastomeric surface secured within the housing and a rotor having a helically-lobed exterior metallic surface disposed within the stator. Pressurized drilling fluid (commonly known as the "mud" or "drilling mud") is pumped into a progressive cavity formed between the rotor and stator. The force of the pressurized fluid pumped into the cavity causes the rotor to turn in a planetary-type motion. A suitable shaft connected to the rotor via a flexible coupling compensates for eccentric movement of the rotor. The shaft is coupled to a bearing assembly having a drive shaft (commonly referred as the "drive sub") which in turn rotates the drill bit attached thereto. Radial and axial bearings in the bearing assembly provide support to the radial and axial movements of the drill bit. For convenience, the power section and bearing assembly are collectively referred to herein as the "motor assembly." Other examples of the drill motors are disclosed in U.S. Pat. Nos. 4,729,675, 4,982,801 and 5,074,681, the disclosures of which are incorporated herein by reference.

The operating or useful life of the motor assembly varies depending upon the downhole conditions, formation type, rock characteristics and the drilling conditions, which include the pressure differential across the rotor of the mud motor, rotational speed of the mud motor, torque, weight on bit ("WOB"), drilling fluid pressure and temperature, type of the drilling fluid used and the condition of the radial and axial bearings. At present, depending upon the downhole and operating conditions, mud motors last between a few hours to a few hundred hours. When the drill bit wears out, the drilling operation must be shut down to pull out the drill string from the borehole to replace the drill bit. If the motor assembly fails prior to the time that the drill string must be retrieved to replace the drill bit, the drilling operation must be stopped to replace the motor assembly. Such motor assembly related failures can significantly increase the drilling cost, especially if the drill string must be retrieved to replace or repair the motor assembly at times other than the drill bit replacement time. It is, thus, highly desirable to continually measure and monitor critical operating motor assembly parameters, perform drilling operations in a manner that will increase the motor assembly life and the drilling efficiency, and measure motor assembly wear for predicting motor assembly failure.

In the presently used drilling systems, the actual downhole values of some of the critical mud motor and bearing assembly parameters, such as the motor rotational speed , motor torque, differential pressure across the rotor, stator temperature, bearing temperature, radial and axial displacement of the drive sub, oil level in the case of sealed-bearing-type bearing assemblies and the actual downhole WOB, are not monitored and utilized to control the drilling operations to increase the motor assembly life, determine the remaining life of the mud motor, determine the bearing assembly wear condition or improve the overall drilling efficiency.

The present invention addresses the above-noted prior art deficiencies and provides a modular drilling system that continually measures various motor assembly operating parameters, including the differential pressure across rotor, torque, motor speed, stator temperature, bearing temperature, radial and axial displacement of the drive shaft and WOB. The system further controls or aids the operator to control the drilling operations to increase the mud motor life, determine the drill motor and bearing assembly wear condition, estimate the remaining mud motor life and improve the overall efficiency of the drilling operations. The drill string preferably comprises modular components and wherein certain measurement devices, such as resistivity or gamma ray devices, azimuthal and inclination devices are placed between the drill bit and the motor power section.

SUMMARY OF THE INVENTION

The present invention provides a drilling system for directional drilling of boreholes. The system contains a drill string having a drill bit rotated by a motor assembly that generates a rotational force in response to pressurized fluid passing therethrough. Sensors placed at selected locations in the motor assembly continually measure various operating parameters, including the differential pressure across the rotor, rotational speed of the mud motor, torque, pressure differential between the fluid passing through the mud motor and the annulus between the motor and the borehole, stator temperature, bearing temperature, radial and axial displacement of the drive shaft, oil volume remaining in the sealed-bearing-type bearing assembly and WOB.

A downhole control circuit having a microprocessor and memory processes signals from the sensors according to programmed instructions downhole and/or commands received from a surface control unit and transmits the processed data uphole to the surface control unit via a suitable telemetry system. The surface control unit may be programmed to operate the drilling system in any number of modes to control the drilling operation in response to the information provided by the various sensors, to monitor the condition of the mud motor and to in situ estimate the remaining life of the mud motor.

In one mode the surface control system may be programmed to control the weight on bit so as to maintain the differential pressure across the rotor at a predetermined value or within a desired range. In another mode the surface control system may be programmed to control the fluid flow to maintain the mud motor rotational speed at a desired value. The surface control system may further be programmed to control the drilling operation as a function of a combination of the measured parameters. For example, the weight on bit may be controlled so as to maintain the differential pressure across the rotor within a desired range and the torque and the rotational speed below their respective maximum limits.

The drill string also preferably contains formation evaluation and testing devises such as a resistivity device for determining the formation resistivity near or in front of the drill bit, a gamma ray device for measuring the gamma ray intensity of the formation, and an inclinometer and azimuth measuring devices. Such devices are preferably placed between the drill bit and the mud motor power section. Further, the devices used in the drill string are preferably modular. The information from the various sensors and devices is utilized by the surface control unit or an operator to cause the drill string to drill the borehole along a desired course. The drill string may contain other measurement-while-drilling ("MWD") and logging-while-drilling devices known in the art for providing information about the borehole conditions and the subsurface geology.

The present invention also provides various methods for controlling the drilling operations during the drilling of a borehole. In one method, the present invention utilizes a drill string having a drill bit at the bottom end and a mud motor for rotating the drill bit when a pressurized fluid is passed through the mud motor. The method comprises the steps of: (a) placing a drill string at the borehole bottom; (b) passing the pressurized fluid through the mud motor to rotate the drill bit; (c) measuring the differential pressure across the mud motor in the borehole; and (d) controlling the drilling of the boreholes as a function of the differential pressure.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

FIGS. *2a–2b* show a longitudinal cross-section of a motor assembly having a mud motor and a non-sealed or mud-lubricated bearing assembly and the preferred manner of placing certain sensors in the motor assembly for continually measuring certain motor assembly operating parameters according to the present invention.

FIGS. *2c* shows a longitudinal cross-section of a sealed bearing assembly and the preferred manner of the placement of certain sensors thereon for use with the mud motor shown in FIG.*2a*.

Figure 1:
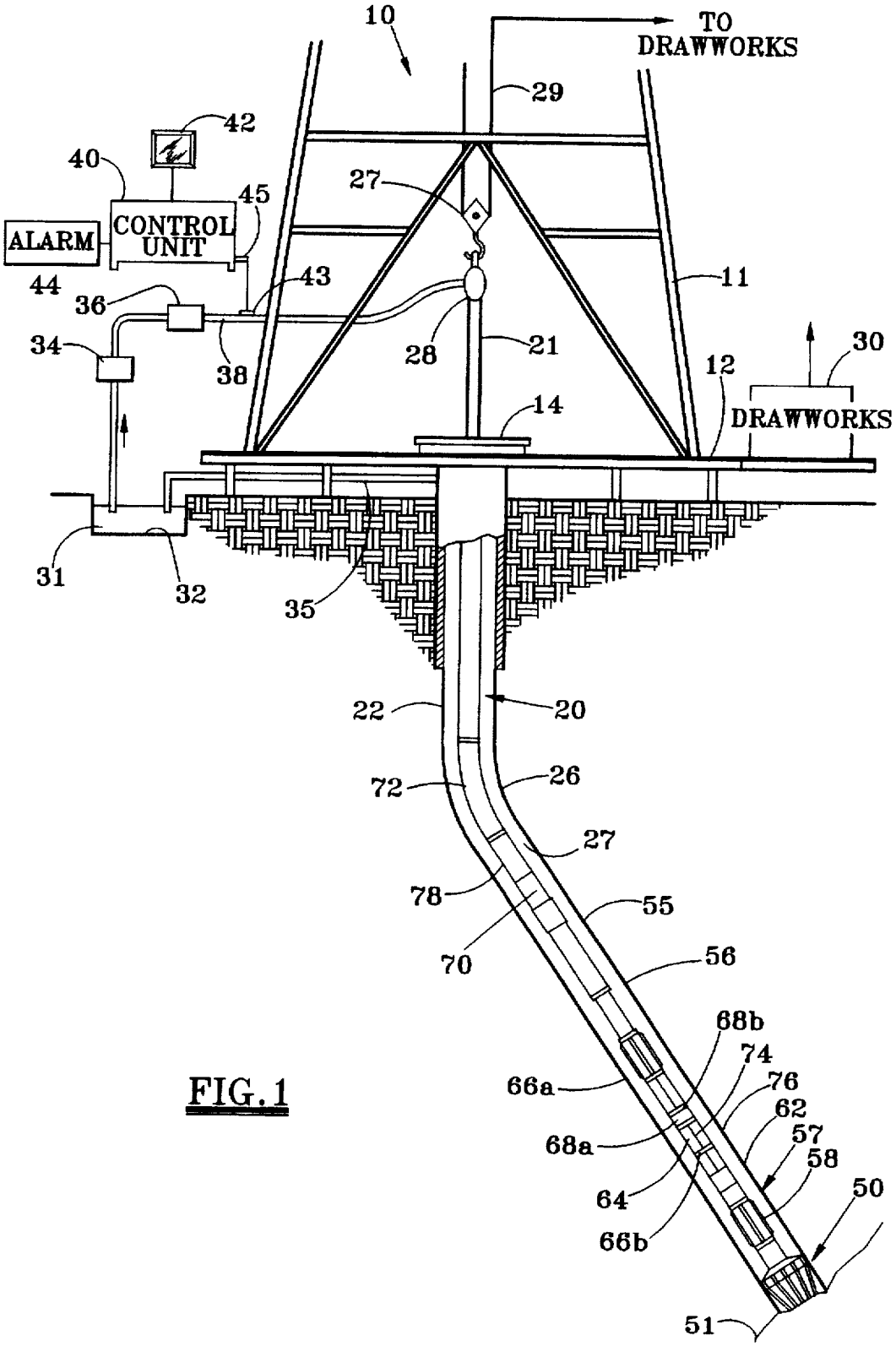
FIG. 1 shows a schematic diagram of a drilling system having a drill string containing a drill bit, mud motor, direction-determining devices, measurement-while-drilling devices and a downhole telemetry according to a preferred embodiment of the present invention.
Figure 3:
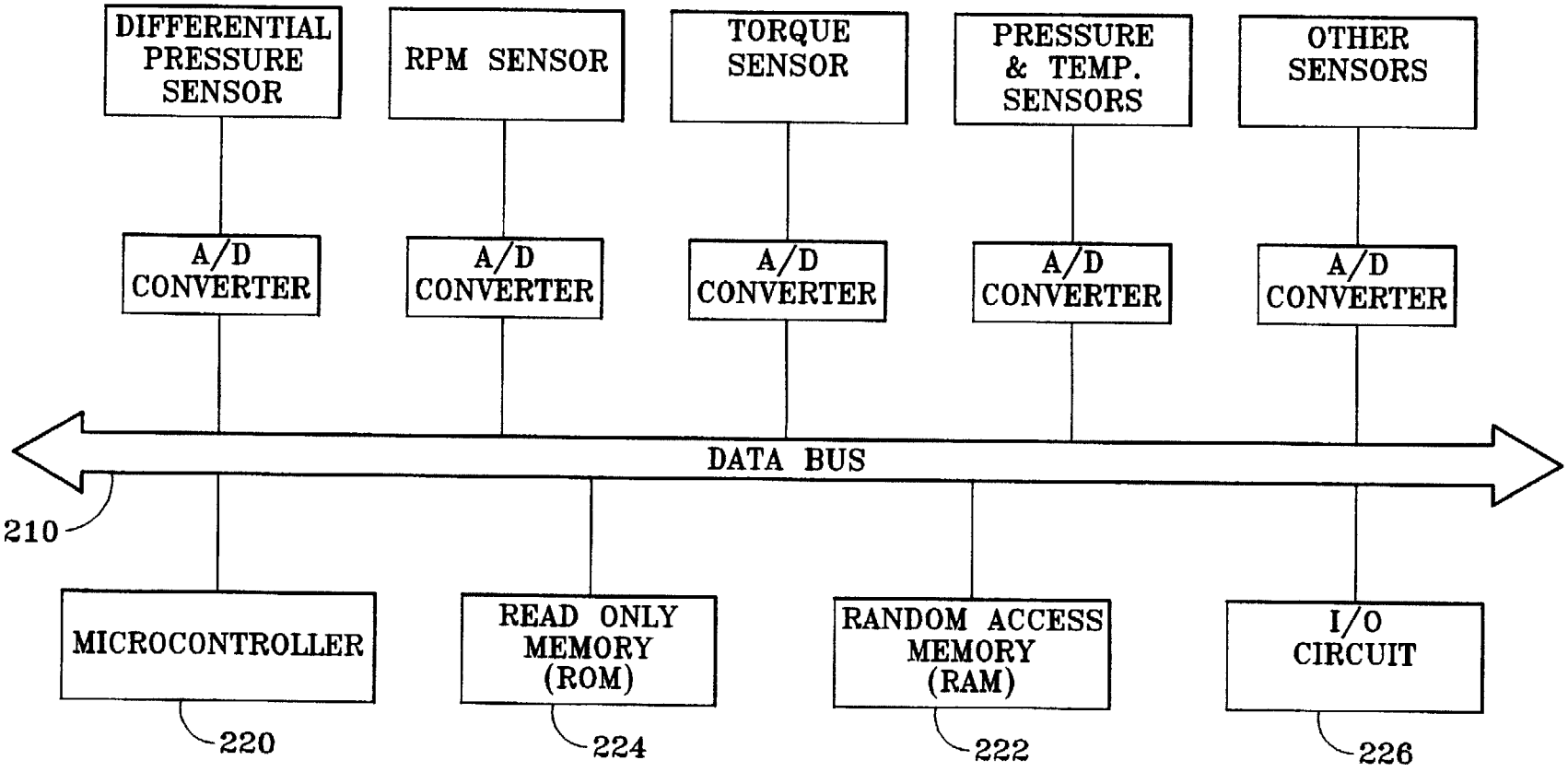

FIG. 3 shows a circuit block diagram for downhole processing of signals from various downhole. sensors used in the system of FIG. 1 and for transmitting such signals to surface equipment for further processing and for controlling the drilling operations.

Figure 4:
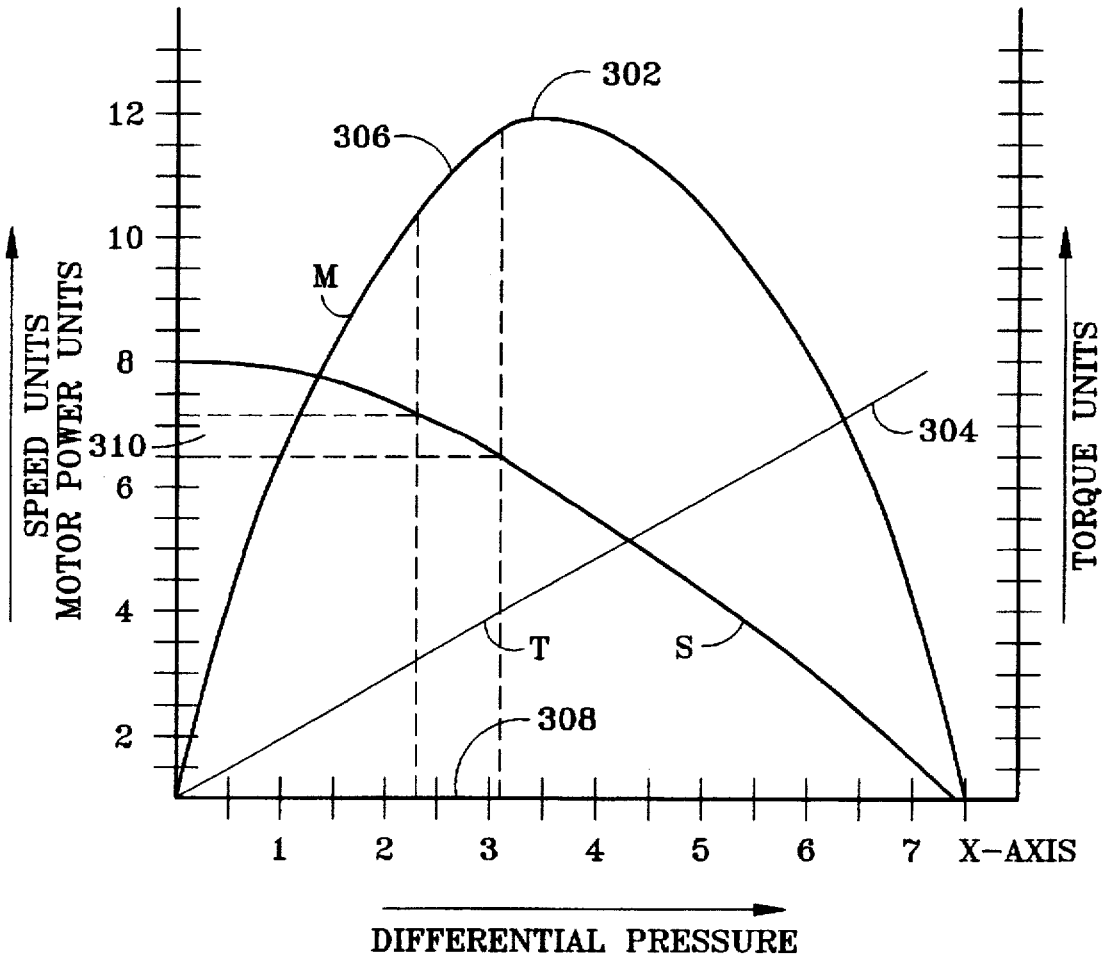

FIG. 4 shows a typical power curve associated with drill motors of the type shown in FIG. *2a*.

DESCRIPTION OF THE PREFERRED EMBODIMENT

The present invention provides a drilling system for directional drilling of boreholes. In general, the system contains a drill string having a drill bit that is rotated by a drive shaft of a bearing assembly coupled to a positive displacement mud motor that generates a rotational force in response to pressurized fluid passing therethrough. Sensors placed at selected locations in the mud motor and drive sub continually measure various operating parameters, including the differential pressure across the mud motor, rotational speed of the mud motor, torque, pressure differential between the fluid passing through the mud motor and the annulus between the drill string and the borehole, stator temperature, radial and axial displacement of the drive shaft of the bearing assembly, oil volume when sealed bearing assembly is used and WOB.

A downhole control circuit having a microprocessor and memory processes signals from these sensors and transmits the processed data uphole to a surface control unit via a suitable telemetry system. The surface control unit may be programmed to operate the drilling system in any number of modes to control the drilling operation in response to the information provided by the various sensors, to monitor the condition of the mud motor and to estimate the remaining life of the mud motor during operations. In one mode, the surface control system may be programmed to control the weight on bit so as to maintain the differential pressure across the rotor at a predetermined value or within a desired range. In another mode, the surface control system controls the fluid flow to maintain the mud motor rotational speed at a desired value. The surface control system may be programmed to control the drilling operation as a function of a combination of the measured parameters. For example, the weight on bit may be controlled so as to maintain the differential pressure across the rotor within a desired range and the torque and the rotational speed below their respective predetermined values.

The drill string also preferably contains formation evaluation and testing devices, such as devices for determining the formation resistivity and/or gamma ray intensity of the formation near or in front of the drill bit, an inclinometer for determining the inclination of the drill string near the drill bit and a device for determining the drill string azimuth. The information from such devices is utilized by the surface control unit to cause the drill string to drill the borehole along a the desired path. The drill string may contain other measurement-while-drilling devices known in the art for providing information about the borehole conditions and the subsurface geology. The preferred embodiments and the operation thereof of the drilling system of the present invention will now be described.

FIG. 1 shows a schematic diagram of a drilling system 10 utilizing a mud motor according to the present invention. As shown, it includes a conventional derrick 11 erected on a derrick floor 12 which supports a rotary table 14 that is rotated by a prime mover (not shown) at a desired rotational speed. It is contemplated that the mud motor of this invention could also be used with the so-called snubbing and coil tubing units. A drill string 20 that includes a drill pipe section 22 extends downward from the rotary table 14 into a borehole 26. A drill bit 50 attached to the drill string end disintegrates the geological formations when it is rotated to drill the borehole 26. The drill string 20 is coupled to a drawworks 30 via a kelly joint 21, swivel 28 and line 29 through a pulley 27. During the drilling operation the drawworks 30 is operated to control the weight on bit and the rate of penetration ("ROP") of the drill string 20 into the borehole 26. The operation of the drawworks is well known in the art and is thus not described in detail herein.

During drilling operations a suitable drilling fluid (commonly referred to in the art as "mud") 31 from a mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid is discharged at borehole bottom 51 through an opening in the drill bit 50. The drilling fluid circulates uphole through the annular space 27 between the drill string 20 and the borehole 26 and is discharged into the mud pit 32 via a return line 35. A surface control unit 40 coupled to a sensor 43 placed in the fluid line 38 is used to control the drilling operation and to display desired drilling parameters and other information on a display/monitor 42. The surface control unit 40 preferably contains a computer, memory for storing data, recorder for recording data and other peripherals. The control unit processes data with a central processing unit and executes program instructions and responds to user commands entered through a suitable device, such as a keyboard, a graphical pointing device or any other suitable device. The control unit 40 is preferably adapted to activate alarms 44 when certain unsafe or undesirable operating conditions occur.

A drill motor or mud motor 55 coupled to the drill bit 50 via a drive shaft (not shown) disposed in a bearing assembly 57 rotates the drill bit S0 when the drilling fluid 31 is passed through the mud motor 55 under pressure. The bearing assembly 57 supports the radial and axial forces of the drill bit, the downthrust of the drill motor and the reactive upward loading from the applied weight on bit. A stabilizer 58 coupled to bearing assembly 57 acts as a centralizer for the lowermost portion of the mud motor assembly.

In one embodiment of the present invention, a number of devices which provide information useful for navigating the drill bit along a desired drilling course are coupled between the drill bit 50 and the drill motor 55. Such devices are preferably of a modular design and include a device for measuring the formation resistivity near and/or in front of the drill bit location in the borehole, a gamma ray device for measuring the formation gamma ray intensity and devices for determining the inclination and azimuth of the drill string.

A formation resistivity measuring device 64 is preferably coupled above the lower kick-off subassembly 62 that provides signals from which resistivity of the formation near or in front of the drill bit 50 is determined. One resistivity measuring device is described in U.S. Pat. No. 5,001,675, which is assigned to the assignee hereof and is incorporated herein by reference. This patent describes a dual propagation resistivity device ("DPR") having one or more pairs of transmitting antennas **66*a* and 66*b* spaced from one or more pairs of receiving antennas 68*a* and 68*b*. Magnetic dipoles are employed which operate in the medium frequency and lower high frequency spectrum. In operation, the transmitted electromagnetic waves are perturbed as they propagate through the formation surrounding the resistivity device 64. The receiving antennas 68*a* and 68*b* detect the perturbed waves. Formation resistivity is derived from the phase and amplitude of the detected signals. The detected signals are processed by a downhole circuit that is preferably placed in a housing 70 above the mud motor 55 and transmitted to the surface control unit 40 using a suitable telemetry system 72**.

An inclinometer 74 and a gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, an azimuth device (not shown), such as a magnetometer or a gyroscopic device, may be utilized to determine the drill string azimuth. Such devices are known in the art and are, thus, are not described in detail herein. In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place.

U.S. Pat. No. 5,325,714, assigned to the assignee hereof, which is incorporated herein by reference, discloses placement of a resistivity device between the drill bit and the mud motor. The above described resistivity device, gamma ray device and the inclinometer are preferably placed in a common housing that may be coupled to the motor in the manner described in U.S. Pat. No. 5,325,714. Additionally, U.S. patent application Ser. No. 08/212,230, assigned to the assignee hereof, which is incorporated herein by reference, discloses a modular system wherein the drill string contains modular assemblies including a modular sensor assembly, motor assembly and kick-off subs. The modular sensor assembly is disposed between the drill bit and the mud motor as described herein above. The present preferably utilizes the modular system as disclosed in U.S. Ser. No. 08/212,230.

Still referring to FIG. 1, logging-while-drilling devices, such as devices for measuring formation porosity, permeability and density, may be placed above the mud motor 64 in the housing 78 for providing information useful for evaluating and testing subsurface formations along borehole 26. U.S. Pat. No. 5,134,285, which is assigned to the assignee hereof, which is incorporated herein by reference, discloses a formation density device that employs a gamma ray source and a detector. In use, gamma rays emitted from the source enter the formation where they interact with the formation and attenuate. The attenuation of the gamma rays is measured by a suitable detector from which density of the formation is determined.

The present system preferably utilizes a formation porosity measurement device, such as that disclosed in U.S. Pat.

No. 5,144,126 which is assigned to the assignee hereof and which is incorporated herein by reference, employs a neutron emission source and a detector for measuring the resulting gamma rays. In use, high energy neutrons are emitted into the surrounding formation. A suitable detector measures the neutron energy delay due to interaction with hydrogen and atoms present in the formation. Other examples of nuclear logging devices are disclosed in U.S. Pat. Nos. 5,126,564 and 5,083,124.

The above-noted devices transmit data to the downhole telemetry system 72, which in turn transmits the received data uphole to the surface control unit 40. The downhole telemetry also receives signals and data from the uphole control unit 40 and transmits such received signals and data to the appropriate downhole devices. The present invention preferably utilizes a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Other telemetry techniques, such electromagnetic and acoustic techniques or any other suitable technique, may be utilized for the purposes of this invention.

The mud motor 55 preferably is the positive displacement kind, which is known in the art. The drilling system 10 of the present invention can continually measure various motor operating parameters downhole and control the drilling operations based on one or more such parameters to increase the life of the mud motor and to improve the overall efficiency of the drilling operations. Before describing placement of the various sensors to measure the motor parameters and the method of operating the drilling system in response to such parameters, it is considered helpful to first describe some of the important operating parameters associated with such motors and the effect of such parameters on the motor performance.

Mud motor manufacturers usually specify the maximum WOB for each motor type and typically recommend that the WOB be maintained within the applicable range for a given motor application, which achieves acceptable ROP and/or directional performance. They also specify the maximum operating differential pressure and the torque. Increasing WOB normally results in an increased motor operating differential pressure and torque output. The amount of differential pressure which can be achieved and consequently the amount of weight under which a motor can operate, while avoiding stall, understeer or oversteer conditions depends on the drill bit/formation interaction and related downhole parameters. The application of excessive WOB, especially if combined with drill string rotation, can result in accelerated wear of internal motor components and high level loading of the driveshaft of the bearing assembly, motor housing and housing connections.

Figure 2A:
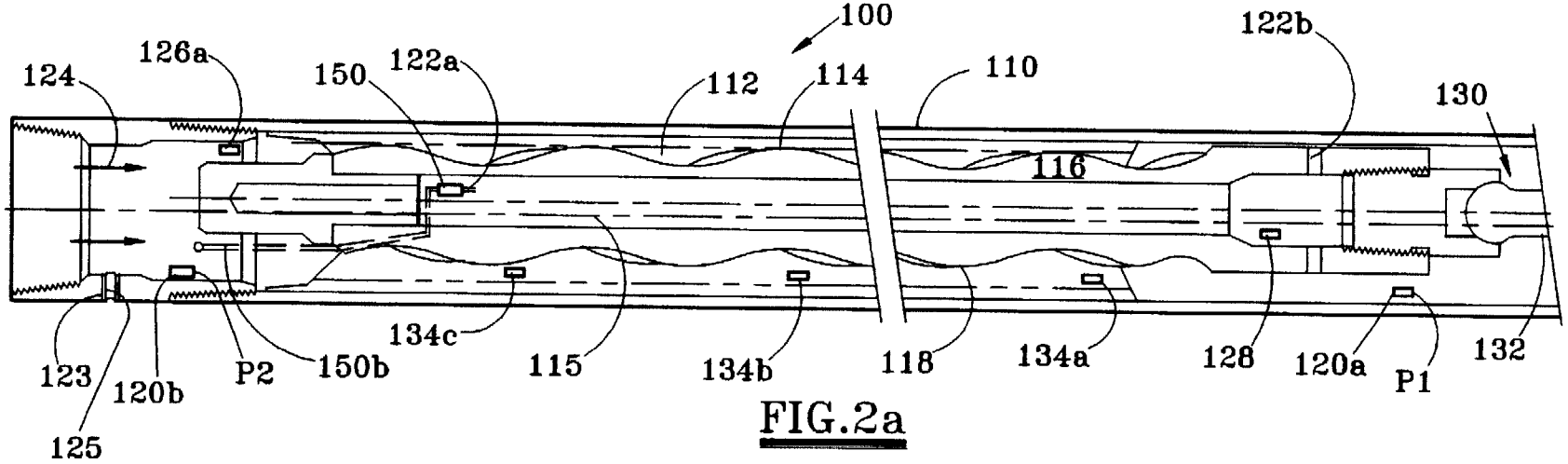
Figure 2B:
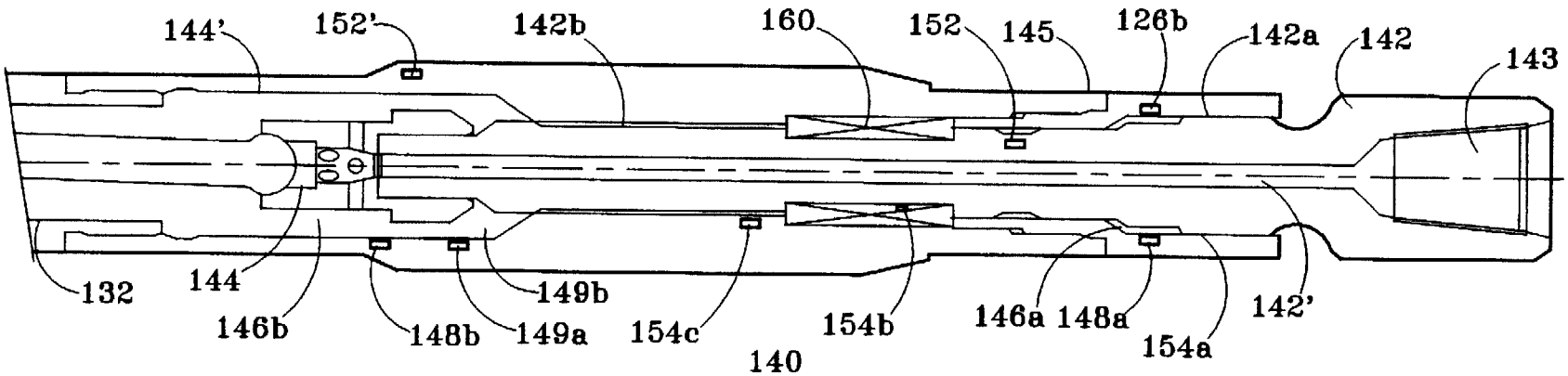

The preferred method of mounting various sensors for determining the motor assembly parameters and the method for controlling the drilling operations in response to such parameters will now be described in detail while referring to FIGS. 2–4. FIGS. 2a–2b show a cross-sectional elevation view of a positive displacement mud motor power section 100 coupled to a mud-lubricated bearing assembly 140 for use in the drilling system 10. The power section 100 contains an elongated housing 110 having therein a hollow elastomeric stator 112 which has a helically-lobed inner surface 114. A metal rotor 116, preferably made from steel, having a helically-lobed outer surface 118 is rotatably disposed inside the stator 112. The rotor 116 preferably has a non-through bore 115 that terminates at a point 122a below the upper end of the rotor as shown in FIG. 2a. The bore 115 remains in fluid communication with the fluid below the rotor via a port 122b. Both the rotor and stator lobe profiles are similar, with the rotor having one less lobe than the stator. The rotor and stator lobes and their helix angles are such that rotor and stator seal at discrete intervals resulting in the creation of axial fluid chambers or cavities which are filled by the pressurized drilling fluid.

The action of the pressurized circulating fluid flowing from the top to bottom of the motor, as shown by arrows 124, causes the rotor 116 to rotate within the stator 112. Modification of lobe numbers and geometry provides for variation of motor input and output characteristics to accommodate different drilling operations requirements.

Still referring to FIGS. 2a–2b, a differential pressure sensor 150 preferably disposed in line 115 senses at its one end pressure of the fluid 124 before it passes through the mud motor via a fluid line 150a and at its other end the pressure in the line 115, which is the same as the pressure of the drilling fluid after it has passed around the rotor 116. The differential pressure sensor thus provides signals representative of the pressure differential across the rotor 116. Alternatively, a pair of pressure sensors $P_1$ and $P_2$ may be disposed a fixed distance apart, one near the bottom of the rotor at a suitable point 120a and the other near the top of the rotor at a suitable point 120b. Another differential pressure sensor 125 (or a pair of pressure sensors) may be placed in an opening 123 made in the housing 110 to determine the pressure differential between the fluid 124 flowing through the motor 110 and the fluid flowing through the annulus 27 (see FIG. 1) between the drill string and the borehole.

To measure the rotational speed of the rotor and thus the drill bit 50, a suitable sensor 126a is coupled to the power section 100. A vibration sensor, magnetic sensor, hall sensor or any other suitable sensor may be utilized for determining the motor speed. Alternatively, a sensor 126b may be placed in the bearing assembly 140 for monitoring the rotational speed of the motor (see FIG. 2b). A sensor 128 for measuring the rotor torque is preferably placed at the rotor bottom. In addition, one or more temperature sensors may be suitably disposed in the power section 100 to continually monitor the temperature of the stator 112. High temperatures may result due to the presence of high friction of the moving parts. High stator temperature can deteriorate the elastomeric stator and thus reduce the operating life of the mud motor. In FIG. 2a three spaced temperature sensors 134a–c are shown disposed in the stator 112 for monitoring the stator temperature.

Each of the above-described sensors generates signals representative of its corresponding mud motor parameter, which signals are transmitted to the downhole control circuit placed in section 70 of the drill string 20 via hard wires coupled between the sensors and the control circuit or by magnetic or acoustic devices known in the art or by any other desirable device or method for further processing of such signals and the transmission of the processed signals and data uphole via the downhole telemetry. U.S. Pat. No. 5,160,925, assigned to the assignee hereof, which is incorporated herein by reference, discloses a modular communication link placed in the drill string for receiving data from the various sensors and devices and transmitting such data upstream. The system of the present invention may also utilize such a communication link for transmitting sensor data to the control circuit or the surface control system.

The mud motor's rotary force is transferred to the bearing assembly 140 via a rotating shaft 132 coupled to the rotor 116. The shaft 132 disposed in a housing 130 eliminates all rotor eccentric motions and the effects of fixed or bent adjustable housings while transmitting torque and downthrust to the drive sub 142 of the bearing assembly 140. The type of the bearing assembly used depends upon the particular application. However, two types of bearing assemblies are most commonly used in the industry: a mud-lubricated bearing assembly such as the bearing assembly 140 shown in FIG. 2*a*, and a sealed bearing assembly, such as bearing assembly 170 shown in FIG. 2*c*.

Referring back to FIG. 2*b*, a mud-lubricated bearing assembly typically contains a rotating drive shaft 142 disposed within an outer housing 145. The drive sub 142 terminates with a bit box 143 at the lower end that accommodates the drill bit 50 (see FIG. 1) and is coupled to the shaft 132 at the upper end 144 by a suitable joint 144'. The drilling fluid from the power section 100 flows to the bit box 143 via a through hole 142' in the drive shaft 142. The radial movement of the drive shaft 142 is restricted by a suitable lower radial bearing 142*a* placed at the interior of the housing 145 near its bottom end and an upper radial bearing 142*b* placed at the interior of the housing near its upper end. Narrow gaps or clearances 146*a* and 146*b* are respectively provided between the housing 145 and the vicinity of the lower radial bearing 142*a* and the upper radial bearing 142*b* and the interior of the housing 145. The radial clearance between the drive shaft and the housing interior varies approximately between 0.150 mm to 0.300 mm depending upon the design choice.

During the drilling operations, the radial bearings, such as shown in FIG. 2*b*, start to wear down causing the clearance to vary. Depending upon the design requirement, the radial bearing wear can cause the drive shaft to wobble, making it difficult for the drill string to remain on the desired course and in some cases can cause the various parts of the bearing assembly to become dislodged. Since the lower radial bearing 142*a* is near the drill bit, even a relatively small increase in the clearance at the lower end can reduce the drilling efficiency. To continually measure the clearance between the drive shaft 142 and the housing interior, displacement sensors 148*a* and 148*b* are respectively placed at suitable locations on the housing interior. The sensors are positioned to measure the movement of the drive shaft 142 relative to the inside of the housing 145. Signals from the displacement sensors 148*a* and 148*b* may be transmitted to the downhole control circuit by conductors placed along the housing interior (not shown) or by any other methods described above in reference to FIGS. 2*a*.

Still referring to FIG. 2*b*, a thrust bearing section 160 is provided between the upper and lower radial bearings to control the axial movement of the drive shaft 142. The thrust bearings 160 support the downthrust of the rotor 116, downthrust due to fluid pressure drop across the bearing assembly 140 and the reactive upward loading from the applied weight on bit. The drive shaft 142 transfers both the axial and torsional loading to the drill bit coupled to the bit box 143. If the clearance between the housing and the drive shaft has an inclining gap, such as shown by numeral 149, then the same displacement sensor 149*a* may be used to determine both the radial and axial movements of the drive shaft 142. Alternatively, a displacement sensor may be placed at any other suitable place to measure the axial movement of the drive shaft 142. High precision displacement sensors suitable for use in borehole drilling are commercially available and, thus, their operation is not described in detail. From the discussion thus far, it should be obvious that weight on bit is an important control parameter for drilling boreholes. A load sensor 152, such as a strain gauge, is placed at a suitable place in the bearing assembly 140 (downstream of the thrust bearings 160) to continuously measure the weight on bit. Alternatively, a sensor 152' may be placed in the bearing assembly housing 145 (upstream of the thrust bearings 160) or in the stator housing 110 (see FIG. 2*a*) to monitor the weight on bit. Various temperature sensors, such as sensors 154*a*–156*c* are placed at selected locations in the bearing assembly 140 to determine the temperature of the bearing assembly 140 at such selected locations during drilling operations.

Figure 2C:
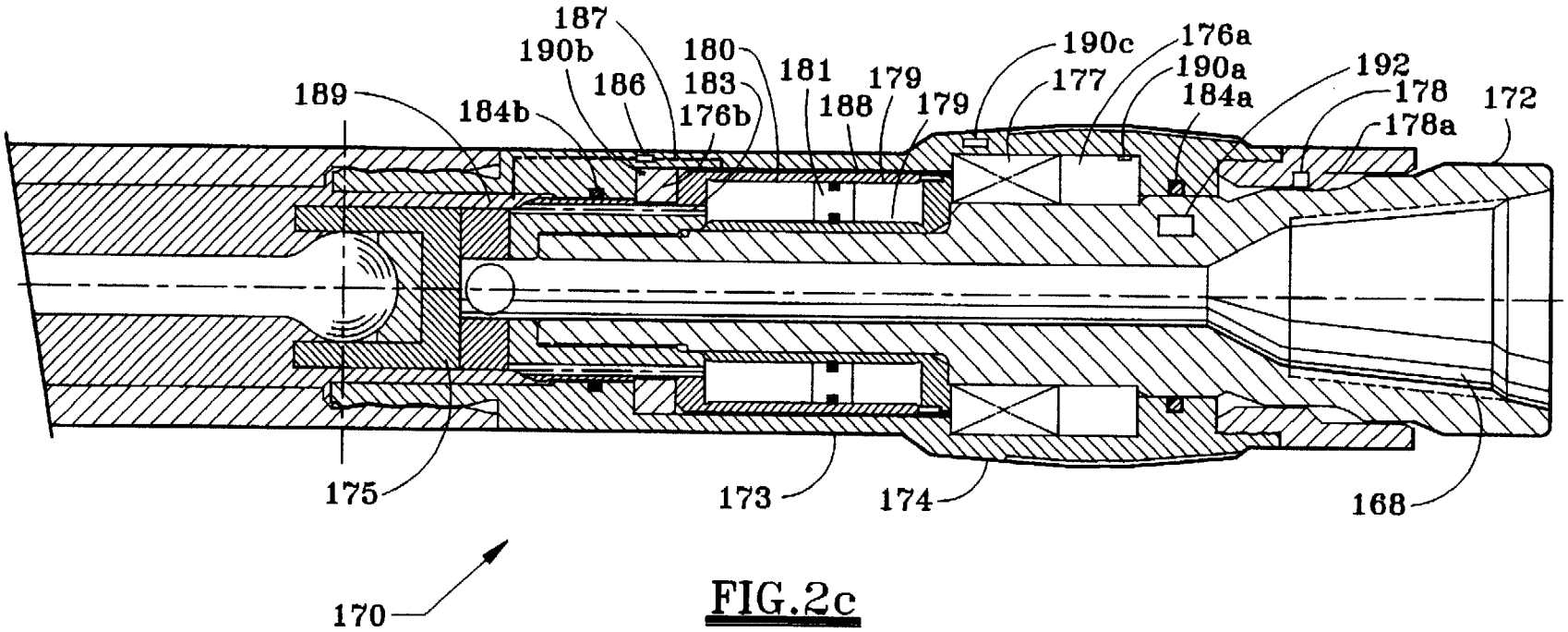

Sealed bearing assemblies are typically utilized for precision drilling and have much tighter tolerances compared to the mud-lubricated bearing assemblies. FIG. 2*c* shows a sealed bearing assembly 170, which contains a drive shaft 172 disposed in a housing 173. The drive shaft is coupled to the motor shaft via a suitable universal joint 175 at the upper end and has a bit box 168 at the bottom end for accommodating a drill bit. Lower and upper radial bearings 176*a* and 176*b* provide radial support to the drive shaft 172 while a thrust bearing 177 provides axial support. One or more suitably placed displacement sensors may be utilized to measure the radial and axial displacements of the drive shaft 172. For simplicity and not as a limitation, in FIG. 2*c* only one displacement sensor 178 is shown to measure the drive shaft radial displacement by measuring the amount of clearance 178*a*.

As noted above, sealed-bearing-type drive subs have much tighter tolerances (as low as 0.001" radial clearance between the drive shaft and the outer housing) and the radial and thrust bearings are continuously lubricated by a suitable working oil 179 contained placed in a cylinder 180. Lower and upper seals 184*a* and 184*b* are provided to prevent leakage of the oil during the drilling operations. However, due to the hostile downhole conditions and the wearing of various components, the oil frequently leaks, thus depleting the reservoir 180, thereby causing bearing failures. To monitor the oil level, a differential pressure sensor 186 is placed in a line 187 coupled between an oil line 188 and the drilling fluid 189 to provide the difference in the pressure between the oil pressure and the drilling fluid pressure. Since the differential pressure for a new bearing assembly is known, reduction in the differential pressure during the drilling operation may be used to determine the amount of the oil remaining in the reservoir 180. Additionally, temperature sensors 190*a*–*c* may be placed in the bearing assembly sub 170 to respectively determine the temperatures of the lower and upper radial bearings 176*a*–*b* and thrust bearings 177. Also, a pressure sensor 192 is preferably placed in the fluid line in the drive shaft 172 for determining the weight on bit. Signals from the differential pressure sensor 186, temperature sensors 190*a*–*c*, pressure sensor 192 and displacement sensor 178 are transmitted to the downhole control circuit in the manner described earlier in relation to FIG. 2*a*.

FIG. 3 shows a block circuit diagram of a portion of an exemplary circuit that may be utilized to perform signal processing, data analysis and communication operations relating to the motor sensor and other drill string sensor signals. The differential pressure sensors 125 and 150, sensor pair P1 and P2, RPM sensor 126*b*, torque sensor 128, temperature sensors 134*a*–*c* and 154*a*–*c*, WOB sensor 152 or 152' and other sensors utilized in the drill string 20, provide analog signals representative of the parameter measured by such sensors. The analog signals from each such sensor are amplified and passed to an associated digital-to-analog (D/A) converter which provides a digital output corresponding to its respective input signal. The digitized sensor data is passed to a data bus 210. A microcontroller 220 coupled to the data bus 210 processes the sensor data downhole according to programmed instruction stored in a read only memory (ROM) 224 coupled to the data bus 210. A random access memory (RAM) 222 coupled to the data bus 210 is utilized by the microcontroller 220 for downhole storage of the processed data. The microcontroller 220 communicates with other downhole circuits via an input/output (I/O) circuit 226. The processed data is sent to the surface control unit 40 (see FIG. 1) via the downhole telemetry 72. For example, the microcontroller can analyze motor operation downhole, including stall, underspeed and overspeed conditions as may occur in two-phase underbalance drilling and communicate such conditions to the surface unit via the telemetry system. The microcontroller 220 may be programmed to merely record the sensor data in the memory 222 and facilitate communication of the data uphole or it may be utilized to perform analyses of the sensor data to compute answers and detect adverse conditions and transmit such information uphole and transmit command and/or alarm signals uphole to cause the surface control unit 40 to take certain actions and/or to aid the drilling operator to take appropriate actions to control the drilling operations.

FIG. 4 shows a graph depicting the motor power output, speed and torque as function of the operating differential pressure across the rotor. The differential pressure is shown along the horizontal axis or x-axis, motor power and motor speed along the left vertical axis and torque along the right vertical axis. Plots M, S and T respectively show the motor power output, motor speed and the torque as a function of operating differential pressure. As the differential pressure increases, the motor output increases and attains a maximum value at point 302 and then starts to decrease. The torque output 304 is substantially proportional to the differential pressure.

The overall drilling efficiency may be increased by maintaining the motor power output within a range 306 that is near the maximum power. This can be achieved by maintaining the mud motor differential pressure and the motor speed within their respective ranges 308 and 310 that correspond to the predetermined motor power output range 306. The motor differential pressure and torque can be controlled by controlling weight on bit while the motor speed can be controlled by controlling the drilling fluid flow. During drilling in some formations, it may be more desirable to operate the drill motor at a different speed or within a range that will cause less wear and tear on the mud motor. In either case, it is desirable to control the drilling operation so as to maintain the differential pressure at or within a desired range.

In one mode, the surface control unit may be programmed to automatically control the WOB so as to maintain the operating differential pressure at a predetermined value or within a predetermined range. The surface control unit 40 may be further programmed to also maintain the torque and WOB at their respective predetermined values. This procedure enables the operator to conduct the drilling operation within the mud motor optimum operating range 306 shown in FIG. 4, thereby increasing the motor life and increasing the overall drilling efficiency. The information about the stator temperature may be transmitted uphole and/or stored in memory downhole for later analysis. It is anticipated that the temperature information will be transmitted periodically when it exceeds a predetermined value. Excessive stator temperature values may be displayed uphole and/or an alarm may be activated when the stator temperature exceeds a predetermined value.

The radial displacement, axial displacement, temperature and oil level data is transmitted to the control circuit, where it is processed according to programmed instructions. The downhole control circuit is preferably programmed to process such sensor data based upon the programmed instructions stored downhole and/or information transmitted by the surface control unit. The downhole control circuit may be programmed to transmit information about the displacement, oil level and temperature when any such parameter is outside a predetermined norm so as to alert the operator of an impending abnormal condition. Such data may also be stored in downhole memory for later use. Further, the surface system may be programmed to shut down the drilling operation when any of a selected measured parameter is outside a predetermined norm.

Thus, the system of the present invention continually measures operating parameters associated with the mud motor and drive sub downhole, processes such signals downhole to make decisions about the operating condition of the motor assembly, transmits data about the measured parameters uphole and aids the drilling operator to improve the drilling efficiency and to increase the operating life of the motor assembly. The system also can perform in situ estimation of the remaining life of the mud motor as described below.

It is known in the art that the power curve for a used or worn positive displacement motors of the type shown in FIG. 2 tends to shrink for a given fluid rate. To determine the condition of the motor or to estimate the remaining life of the motor without retrieving the drill string to perform physical inspection, as it is commonly done in the prior art, the variation of the RPM, as the WOB is increased from zero up to its maximum, is measured. By comparing the RPM at the same differential pressures of the new motor and of the motor after certain use, the condition of the motor may be determined and the remaining life of the motor may be estimated. As there are a large number of motor configurations that are used for various applications, the motor performance data relating to new motors is preferably stored in the surface control memory. The surface control unit 40 may be programmed to calculate and display on the monitor 44 the wear condition and operating life of the mud motor.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A mud motor for use in drilling a borehole, comprising:

(a) a stator having a helically contoured inner surface;

(b) a rotor having a helically contoured outer surface rotatably disposed in the stator to rotate along a common axis of the stator and motor, said rotor cooperating with the stator when a pressurized fluid at a known fluid flow rate is passed between the stator and the rotor to generate rotary force; and (c) a sensor within the mud motor for determining pressure differential across the rotor at the known fluid flow rate.

2. The apparatus as specified in claim 1, wherein the sensor is a differential pressure sensor.

3. The apparatus as specified in claim 1, wherein the sensor for determining the differential pressure comprises a pair of pressure sensors for determining pressure across a fixed distance along a length of the rotor axis.

4. The apparatus as specified in claim 1, wherein the sensor for determining the differential pressure comprises a first pressure sensor for determining pressure of the fluid above the rotor and a second pressure sensor for determining pressure of the fluid below the rotor.

5. The apparatus as specified in claim 1 further having a sensor associated therewith for determining rotary speed of the rotor.

6. The apparatus as specified in claim 2 further having a sensor associated therewith for determining rotor torque.

7. The apparatus as specified in claim 1 further having a sensor associated therewith for determining vibration of the mud motor.

8. The apparatus as specified in claim 1 further having a sensor associated therewith for determining temperature at a suitable place on the mud motor.

9. The apparatus as specified in claim 8, wherein the temperature sensor measures the stator temperature.

10. A mud motor for use in drilling a borehole, comprising:

a) a stator having a helically contoured inner surface;

b) a rotor having a helically contourer outer surface rotatably disposed in the stator to rotate along a common axis of the stator and motor, said rotor cooperating with the stator when a pressurized fluid is passed between the stator and the rotor to generate rotary force; and c) at least one temperature sensor within the mud motor for measuring the temperature of a mud motor element for determining an operating parameter of the mud motor during the drilling of the borehole.

11. The mud motor as specified in claim 10, wherein the mud motor element is the stator.

12. The mud motor as specified in claim 10, wherein the at least one temperature sensor includes a plurality of sensors.

13. The mud motor as specified in claim 10, wherein the operating parameter is selected from a group comprising (a) an indication of thermal decay of the stator; (b) an indication of high friction due to moving parts of the mud motor; and (c) an indication of operating life of the mud motor.

14. A mud motor assembly for use in drilling a borehole, comprising:

a) a mud motor having a stator having a helically contoured inner surface, a rotor having a helically contoured outer surface rotatably disposed in the stator, said rotor cooperating with the stator when a pressurized fluid is passed between the stator and the rotor to generate rotary force; and (b) a bearing assembly having a drive shaft rotatably disposed in a housing, said drive shaft adapted to be rotated by the mud motor, said bearing assembly further having a sensor associated therewith for measuring radial displacement of the drive shaft when said drive shaft is rotated.

15. The apparatus as defined in claim 14, wherein the bearing assembly has one or more radial bearings for providing radial support to the drive shaft.

16. The apparatus as defined in claim 15 further having an axial bearing for providing axial support to the drive shaft.

17. The apparatus as defined in claim 15 further having a sensor associated with the bearing assembly for determining axial displacement of the drive shaft when the drive shaft is rotated.

18. The apparatus as defined in claim 15 further having a temperature sensor for determining the temperature of the bearing assembly.

19. The apparatus as defined in claim 15, wherein the radial bearings are sealed and lubricated by a suitable oil.

20. The apparatus as defined in claim 16, wherein the radial bearings and axial bearings are sealed and lubricated by a suitable oil.

21. The apparatus as defined in claim 19, wherein the oil is placed in a reservoir.

22. The apparatus as defined in claim 21 further having a sensor associated therewith for measuring the oil level in the reservoir.

23. The apparatus as defined in claim 14 further having a sensor associated therewith for determining weight on bit (WOB).

24. The apparatus as defined in claim 14 further having a sensor associated with the mud motor for determining pressure differential across the rotor when the pressurized fluid passes between the rotor and the stator.

25. The apparatus as specified in claim 24, wherein the sensor is a differential pressure sensor.

26. The apparatus as specified in claim 25, wherein the differential pressure sensor is placed within the rotor.

27. The apparatus as specified in claim 24, wherein the sensor for determining the differential pressure comprises a pair of pressure sensors for determining pressure across a fixed distance.

28. The apparatus as specified in claim 1 further having a sensor associated therewith for determining temperature at a suitable place on the mud motor.

29. The apparatus as specified in claim 1 further having a sensor associated therewith for determining the motor rotational speed.

30. A drilling tool assembly for use in drilling a borehole, comprising:

(a) a drill bit;

(b) a mud motor coupled to the drill for rotating the drill bit, said mud motor having:

(i) a stator having a helically contoured inner surface, (ii) a rotor having a helically contoured outer surface rotatably disposed in the stator to rotate along a common axis of the stator and motor, said rotor cooperating with the stator when a pressurized fluid is passed through the mud motor to generate rotary force, (iii) a sensor within the mud motor for providing signals representative of the pressure differential across the mud motor when the pressurized fluid passes through the mud motor; and (c) a measurement-while-drilling (MWD) device for determining a formation parameter during drilling of the borehole.

31. The apparatus as specified in claim 30, wherein the MWD device is a resistivity device placed between the mud motor and the drill bit.

32. The apparatus as specified in claim 30, wherein the MWD device is an inclinometer placed between the mud motor and the drill bit for determining the inclination of the drilling tool assembly during drilling of the borehole.

33. The apparatus as specified in claim 30, wherein the MWD device is a device for determining the azimuth of a portion of the drill string.

34. The apparatus as specified in claim 30, wherein a gamma ray device placed between the drill bit and the mud motor for determining the gamma ray intensity of the formation is utilized as the MWD device.

35. The apparatus as specified in claim 30, wherein the MWD device includes a resistivity device for measuring the formation resistivity and a gamma ray device for measuring the gamma ray intensity of the formation.

36. The apparatus as specified in claim 30, wherein the MWD device includes devices for determining the borehole inclination and the drill tool azimuth.

37. The apparatus as specified in claim 30, wherein the MWD device includes a resistivity device for measuring the formation resistivity, a gamma ray device for measuring the gamma ray intensity of the formation, device for determining the borehole inclination and a device for determining the drill tool azimuth.

38. The apparatus as specified in claim 37, wherein the resistivity, gamma and inclination measuring devices are all placed in a single modular section disposed between the drill bit and the mud motor.

39. A drilling tool assembly for use in drilling a borehole, comprising:

(a) a mud motor having a stator having a helically contoured inner surface, a rotor having a helically contoured outer surface rotatably disposed in the stator, said rotor cooperating with the stator when a pressurized fluid is passed through the mud motor to generate rotary force, and a sensor within the mud motor for providing signals representative of the pressure differential across the rotor when the pressurized fluid passes through the mud motor at a known fluid flow rate;

(b) a control circuit for receiving and processing signals from the sensor; and (d) a telemetry system for receiving signals from the control circuit and for transmitting such received signals to other devices.

40. The apparatus as specified in claim 39, wherein the control circuit includes a microprocessor.

41. The apparatus as specified in claim 40, wherein the control circuit includes a memory for storing therein programmed instructions.

42. The apparatus as specified in claim 41, wherein the telemetry system transmits signals utilizing a mud pulse technique.

43. The apparatus as specified in claim 41, wherein the telemetry system transmits signals utilizing acoustic signals.

44. The apparatus as specified in claim 39 further having sensor for determining the motor rotational speed and torque during drilling of the borehole.

45. The apparatus as specified in claim 39 further having a resistivity device placed between the mud motor and the drill bit for determining the formation resistivity.

46. The apparatus as specified in claim 39 further having an inclinometer placed between the mud motor and the drill bit for determining the inclination of the drilling tool assembly during drilling of the borehole.

47. The apparatus as specified in claim 39 further having a device for determining the azimuth of a portion of the drill string.

48. The apparatus as specified in claim 39 further having a gamma ray device placed between the drill bit and the mud motor for determining the gamma ray intensity of the formation.

49. The apparatus as specified in claim 39 further having a resistivity device for measuring the formation resistivity and a gamma ray device for measuring the gamma ray intensity of the formation.

50. The apparatus as specified in claim 39 further having additional drill string-installed sensor devices for determining the borehole inclination and the drill tool azimuth.

51. The apparatus as specified in claim 39 further having a resistivity device for measuring the formation resistivity, a gamma ray device for measuring the gamma ray intensity of the formation, device for determining the borehole inclination and a device for determining the drill tool azimuth.

52. The apparatus as specified in claim 51, wherein the resistivity, gamma and inclination measuring devices are all placed in a single modular section disposed between the drill bit and the mud motor.

53. A system for drilling boreholes, comprising:

(a) a drill string having a drill bit at a bottom end;

(b) a mud motor coupled to the drill bit, said mud motor rotating the drill bit when a pressurized fluid is passed through the mud motor, said mud motor developing pressure differential across the mud motor when the mud motor is rotating the drill bit, said mud motor including a sensor within the mud motor for providing signals representative of the pressure differential across the mud motor;

(c) a drawworks coupled to the drill string for controlling weight on bit (WOB) during the drilling of the boreholes; and (d) a surface control system for receiving signals representative of the differential pressure across the motor and in response thereto for controlling the WOB during drilling of the boreholes for minimizing mud motor wear.

54. The apparatus as specified in claim 53 further having a sensor coupled to the mud motor for providing signals representative of the rotational speed of the mud motor.

55. The apparatus as specified in claim 54 wherein the surface control system receives signals representative of the rotational speed of the motor and controls the pressure of the fluid passing through the mud motor during the drilling of the boreholes.

56. The apparatus as specified in claim 55 further having a sensor coupled to the mud motor for providing signals representative of the torque on a shaft coupled to the motor.

57. The apparatus as specified in claim 56, wherein the surface control system receives signals representative of the torque and controls the pressure of the fluid passing through the mud motor during the drilling of the boreholes.

58. The apparatus as specified in claim 56, wherein the surface control system controls the WOB so as to maintain the differential pressure across the motor within a predetermined range.

59. The apparatus as specified in claim 53 further having a module containing resistivity, inclination and azimuth measuring devices placed between the drill bit and the mud motor.

60. The apparatus as specified in claim 59 further having a logging-while-drilling device placed between the mud motor and the surface control system for determining a characteristic of the earth formation surrounding the borehole being drilled.

61. A method of drilling a borehole utilizing a drill string having a drill bit at a bottom end and a mud motor coupled to the drill bit for rotating the drill bit when a pressurized fluid is passed through the mud motor, said method comprising the steps of:

(a) placing the drill string in the wellbore with the drill bit at the borehole bottom;

(b) passing the pressurized fluid through the mud motor at a known fluid flow rate to rotate the drill bit;

(c) measuring differential pressure across the mud motor with a sensor in the mud motor; and (d) controlling the drilling of the borehole by controlling weight on the drill bit so as to maintain the differential pressure within a predetermined range of values.

62. The method as specified in claim 61, wherein the range of values constitute a single value.

63. The method as specified in claim 61 further containing the step of controlling the flow of the pressurized fluid so as to maintain the rotational speed of the mud motor below a maximum value.

64. The method as specified in claim 63 further comprising the steps:

(a) measuring rotor torque of the mud motor; and (b) controlling weight on bit so as to also maintain the rotor torque below a maximum value.

65. A method of determining the wear condition of a first mud motor during drilling of a borehole by a drill string having a drill bit at a bottom end that is rotated by the first mud motor when a pressurized fluid is passed through the first mud motor, said first mud motor developing pressure differential across the first mud motor when the pressurized fluid passes therethrough, said method comprising:

(a) placing the drill string in the borehole;

(b) drilling the borehole for a period of time at an known value of weight on the drill bit (WOB);

(c) reducing WOB to a relatively small value compared to the known WOB;

(c) measuring differential pressure across the first mud motor at the reduced WOB and at a known fluid flow rate through the first mud motor; and (d) comparing the measured differential pressure with a differential pressure measurement made at the known fluid flow rate of a second mud motor to determine the wear condition of the mud motor.

66. The method according to claim 65, wherein the relatively low WOB is substantially equal to zero.

67. The method according to claim 65, wherein the differential pressure across the first mud motor is measured by a sensor selected from the group comprising a differential pressure sensor within the first mud motor and a pair of spaced apart pressure sensors in the first mud motor.

68. The method according to claim 65, wherein the second mud motor is relatively new and substantially identical in design to the first mud motor.

69. A drilling assembly for use in drilling a wellbore, comprising:

(a) a drilling motor for generating rotary force in response to the flow of a pressurized fluid through the drilling motor; and (b) a bearing assembly having:

(i) a housing;

(ii) a drive shaft rotatably disposed in the housing, said drive shaft adapted to be rotated by the drilling motor;

(iii) at least one radial bearing between the drive shaft and the housing for providing lateral restraint to the drive shaft;

(iv) a thrust bearing in the bearing assembly for restricting axial movement of the drive shaft during drilling of the wellbore; and (v) at least one sensor in the bearing assembly that is selected from a group of sensors comprising a radial displacement sensor for determining the radial displacement of the drive shaft, an axial displacement sensor for determining the axial displacement of the drill shaft, at least one temperature sensor for determining the temperature of the bearing assembly at a selected location in the bearing assembly, and a pressure sensor for determining weight on bit during drilling of the wellbore with the drilling assembly.

70. The drilling assembly according to claim 69, wherein the at least one radial bearing comprises a first and a second spaced apart radial bearings.

71. The drilling assembly according to claim 70, wherein the thrust bearing is disposed between the first and second radial bearings.

72. The drilling assembly according to claim 69, wherein the at least one sensor comprises at least one radial displacement sensor and an axial displacement sensor.

73. The drilling assembly according to claim 71, wherein the at least one sensor comprises (a) a first radial displacement sensor for measuring the radial displacement of the drill shaft adjacent the first radial bearing, (b) a second radial displacement sensor for measuring the displacement of the drill shaft adjacent the second radial bearing, and (c) an axial displacement sensor for measuring the axial displacement of the drill shaft.

74. The drilling assembly according to claim 73, wherein the at least one sensor further comprises at least one temperature sensor for determining the temperature at a selected location of the bearing assembly.

75. The drilling assembly according to claim 73, wherein the at least one sensor further comprises at least one load sensor for determining weight on bit during drilling of the wellbore.

76. A drilling assembly for use in drilling of a wellbore, comprising:

(a) a drilling motor for generating rotary force in response to the flow of a pressurized fluid through the drilling motor; and (b) a bearing assembly comprising:

(i) a housing;

(ii) a drive shaft rotatably disposed in said housing, said drive shaft adapted to be rotated by the drilling motor, and wherein said drive shaft and said housing defining an inclining gap therebetween; and (c) a sensor associated with the inclining gap for determining radial and axial displacements of the drill shaft relative to the housing during drilling of the wellbore.

77. The drilling assembly according to claim 76 further comprising at least one radial bearing assembly for restricting radial movement the drive shaft and a thrust bearing for restricting axial movement of the drill shaft.

78. The drilling assembly according to claim 77 further comprising a second sensor in the bearing assembly that is selected from a group of sensors comprising at least one temperature sensor for determining the temperature at a selected location of the bearing assembly and at least one load sensor for determining weight on bit during drilling of the wellbore.

79. A bearing assembly for use in drilling of a wellbore, comprising:

(a) a housing;

(b) a drive shaft rotatably disposed in the housing for rotating a drill bit during drilling of the wellbore;

(c) at least one radial bearing between the drive shaft and the housing for providing lateral restraint to the drive shaft;

(d) a thrust bearing in the bearing assembly for restricting axial movement of the drive shaft during drilling of the wellbore;

(e) a source of lubricating fluid for providing the lubricating fluid to the at least one radial bearing and the thrust bearing to lubricate such bearings during drilling of the wellbore; and (f) a sensor disposed within or adjacent to said housing which is associated with the source of the lubricating fluid for providing a measurement for determining at least one of the (i) presence of a leak between the source and the bearing, (b) wear condition of the at least one radial bearing, or the remaining life of the at least one radial bearing.

80. The bearing assembly according to claim 79, wherein the at least one radial bearing includes a first and second spaced apart radial bearings, each said first and second radial bearings and wherein the thrust bearing is disposed between said first and second radial bearings.

81. The bearing assembly according to claim 79, wherein the sensor is a differential pressure sensor for providing signals corresponding to the difference in pressure between the source of the lubricating fluid and the outside environment.

82. The bearing assembly according to claim 81, wherein the differential pressure sensor is disposed in a line placed between the source and the outside environment.

* * * * *

UNITED STATES PATENT AND TRADEMARK OFFICE

CERTIFICATE OF CORRECTION

PATENT NO. : 5,679,894
DATED : October 21, 1997
INVENTOR(S) : Kruger, et al

It is certified that error appears in the above-identified patent and that said Letters Patent is hereby corrected as shown below:

Column 13, line 1, change "1" to --2--.

Column 13, line 25, change "contourer" to --contoured--.

Column 14, line 64, after "wherein" insert -- the MWD device is --.

Column 15, line 45, before "sensor" insert -- a --.

Column 17, line 6, replace "containing" with -- comprising --.

Column 18, line 49, replace "comprising" with -- containing--.

Column 19, line 7, replace "(b)" with -- (ii) --.

Column 19, line 8, replace "or" with -- and (iii) --.

Signed and Sealed this

Third Day of March, 1998

Bruce Lehman

*Attest:*

BRUCE LEHMAN

*Attesting Officer*

*Commissioner of Patents and Trademarks*